US011446794B2

(12) United States Patent
Tian et al.

(10) Patent No.: US 11,446,794 B2
(45) Date of Patent: Sep. 20, 2022

(54) UNIVERSAL FAUCET NUT WRENCH

(71) Applicant: OLYMPIA TOOLS INTERNATIONAL, INC., Covina, CA (US)

(72) Inventors: Yeqing Tian, Shanghai (CN); Jonathan S. Beckwith, Raleigh, NC (US)

(73) Assignee: OLYMPIA TOOLS INTERNATIONAL, INC., Covina, CA (US)

( * ) Notice: Subject to any disclaimer, the term of this patent is extended or adjusted under 35 U.S.C. 154(b) by 349 days.

(21) Appl. No.: 16/832,822

(22) Filed: Mar. 27, 2020

(65) Prior Publication Data

US 2021/0053195 A1 Feb. 25, 2021

Related U.S. Application Data

(63) Continuation-in-part of application No. 29/724,666, filed on Feb. 18, 2020.

(30) Foreign Application Priority Data

Aug. 22, 2019 (CN) ..... 201930458312.0

(51) Int. Cl.
*B25B 13/50* (2006.01)
*B25B 13/48* (2006.01)
*B25B 23/00* (2006.01)

(52) U.S. Cl.
CPC ..... *B25B 13/5091* (2013.01); *B25B 13/481* (2013.01); *B25B 23/0035* (2013.01)

(58) Field of Classification Search
CPC ... B25B 13/48; B25B 13/481; B25B 13/5091; B25B 23/0035
See application file for complete search history.

(56) References Cited

U.S. PATENT DOCUMENTS 5,048,378 A * 9/1991 Nikolas ..... B25B 13/50 81/176.15
5,996,447 A * 12/1999 Bayouth ..... B25B 13/06 81/124.2
6,701,807 B1 3/2004 Gammon
2005/0051003 A1* 3/2005 Stern ..... B25B 13/06 81/176.3

(Continued)

*Primary Examiner* — David B. Thomas
(74) *Attorney, Agent, or Firm* — Patterson + Sheridan, LLP

(57) ABSTRACT

A method and apparatus for installing or uninstalling supply lines or retaining nuts. A wrench includes a body having first and second sections rotatably coupled to each other. The body includes a first portion having a plurality of castellations, wherein a plurality of radial slots are formed between lateral surfaces of adjacent castellations, each radial slot being engageable to a wing of a retaining nut, wherein the first portion includes a plurality of first inner surfaces engageable to a first pipe fitting in the closed position. The body includes a second portion spaced away from the first portion, the second portion including a hinge for rotating the first and second sections relative to each other. The body includes a third portion located between the first and second portions, the third portion including a plurality of second inner surfaces engageable to a second pipe fitting in the closed position.

20 Claims, 12 Drawing Sheets

(56) References Cited

U.S. PATENT DOCUMENTS

| | | | | |
|---|---|---|---|---|
| 2008/0034927 | A1* | 2/2008 | Adkins | B25B 13/48 81/124.2 |
| 2008/0066584 | A1* | 3/2008 | Vines | B25B 13/481 81/124.2 |
| 2016/0339563 | A1* | 11/2016 | Wilson | B25B 21/002 |

* cited by examiner

UNIVERSAL FAUCET NUT WRENCH

CLAIM OF PRIORITY

The present application is a continuation-in-part of U.S. Design patent application Ser. No. 29/724,666 filed Feb. 18, 2020, entitled, "Universal Faucet Nut Wrench," which claims benefit of Chinese Patent Application No. 201930458312.0 filed Aug. 22, 2019, each of which are hereby expressly incorporated by reference herein.

BACKGROUND

Embodiments described herein generally relate to a wrench for plumbing applications where limited access is available. For example, only a narrow clearance may exist on the underside of basin for installing or uninstalling supply lines or retaining nuts. Therefore, conventional tools may exhibit problems with access, slippage, or difficulty in handling or applying torque. Embodiments of this disclosure overcome at least some of these issues.

SUMMARY

The present disclosure generally describes a universal faucet nut wrench having an open position for installing around an existing supply line and a closed position for engaging one of a retaining nut or a pipe fitting. The wrench includes a body having first and second sections rotatably coupled to each other. The body includes a first portion having a plurality of castellations, wherein a plurality of radial slots are formed between lateral surfaces of adjacent castellations, wherein each radial slot is engageable to a wing of a retaining nut, and wherein the first portion includes a plurality of first inner surfaces engageable to a first pipe fitting in the closed position. The body includes a second portion spaced away from the first portion, wherein the second portion includes a hinge for rotating the first and second sections relative to each other. The body includes a third portion located between the first and second portions, wherein the third portion includes a plurality of second inner surfaces engageable to a second pipe fitting in the closed position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
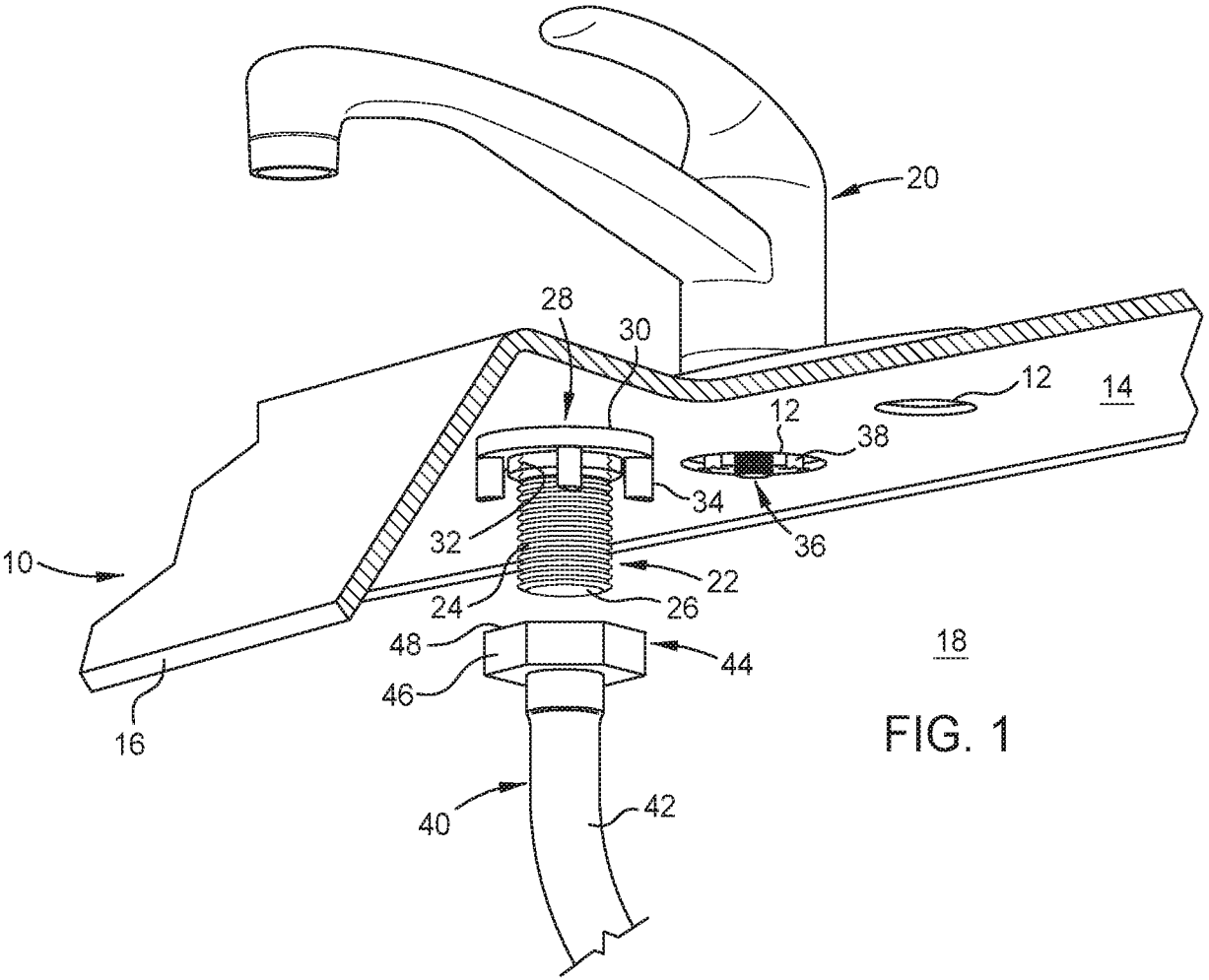
FIG. 1 is a partial cut away perspective view of an underside of a basin, in accordance with some embodiments.

Embodiments of the present disclosure include a universal faucet nut wrench having an open position for installing around an existing supply line and a closed position for engaging one of a retaining nut or a pipe fitting. The wrench includes a body having first and second sections rotatably coupled to each other. The body includes a first portion having a plurality of castellations, wherein a plurality of radial slots are formed between lateral surfaces of adjacent castellations, wherein each radial slot is engageable to a wing of a retaining nut, and wherein the first portion includes a plurality of first inner surfaces engageable to a first pipe fitting in the closed position. The body further includes a second portion spaced away from the first portion, wherein the second portion includes a hinge for rotating the first and second sections relative to each other. The body further includes a third portion located between the first and second portions, wherein the third portion includes a plurality of second inner surfaces engageable to a second pipe fitting in the closed position.

Embodiments of the present disclosure include a method for disconnecting a pipe fitting from a faucet and/or connecting the pipe fitting to the faucet. The method includes providing a wrench having a first portion and a second portion, wherein the first portion includes a plurality of castellations, wherein a plurality of radial slots are formed between lateral surfaces of adjacent castellations, wherein each castellation includes a first inner surface engageable to a first pipe fitting in the closed position, and wherein the second portion includes a hinge for rotating first and second sections of the wrench relative to each other. The method further includes opening the wrench by rotating the first and second sections relative to each other in a first direction. The method further includes installing the wrench around the supply line. The method further includes closing the wrench around the supply line by rotating the first and second sections relative to each other in a second direction opposite the first direction. The method further includes moving the wrench longitudinally relative to the supply line. The method further includes engaging each of the plurality of first inner surfaces of the wrench to an outer surface of the pipe fitting. The method further includes rotating the pipe fitting via the wrench, wherein rotating the pipe fitting performs at least one of: disconnecting the pipe fitting from the faucet; and connecting the pipe fitting to the faucet.

Embodiments of the present disclosure include a universal faucet nut wrench having an open position for installing around an existing supply line and a closed position for engaging one of a retaining nut or a pipe fitting. The wrench includes a body having first and second sections rotatably coupled to each other. The body includes a first portion having a plurality of castellations, wherein a plurality of radial slots are formed between lateral surfaces of adjacent castellations, and wherein each radial slot is engageable to a wing of a retaining nut. The body further includes a second portion located adjacent the first portion, wherein the second portion includes a plurality of second inner surfaces engageable to a first pipe fitting in the closed position.

FIG. 1 is a partial cut away perspective view of an underside of a basin 10, in accordance with some embodiments. The basin 10 may be a sink, tub, toilet, or other similar water enclosure. The basin 10 includes one or more faucet stem holes 12 formed through a top wall 14 thereof. The basin 10 includes a sidewall 16 forming at least a portion of a topside water enclosure. The sidewall 16 restricts access to an underside of the basin 10. The basin 10 may be positioned adjacent to a back panel 18. The back panel 18 may be a cabinet, wall, frame, or other structure that supports the basin 10. The back panel 18 also restricts access to the underside of the basin 10.

A plumbing fixture 20 is installed on the top wall 14 of the basin 10. The plumbing fixture 20 may be a faucet, spray hose, or other fixture for supplying water to the topside of the basin 10. The plumbing fixture 20 includes one or more faucet stems 22 extending downward therefrom. The faucet stems 22 extend through respective faucet stem holes 12 when the plumbing fixture 20 is installed on the basin 10. The faucet stems 22 include an outer threaded surface 24 and an internal bore 26. The plumbing fixture 20 is secured to the basin 10 by threading a retaining nut 28 onto the outer threaded surface 24 of each faucet stem 22 and tightening the retaining nut 28 against the top wall 14 of the basin 10. The retaining nut 28 may be made of PVC, other plastics, stainless steel, or other metals. The retaining nut 28 may be a locknut. The retaining nut 28 includes a base 30 having a threaded internal bore 32 complementary to the outer threaded surface 24 of the faucet stem 22. The retaining nut 28 includes wings 34 for engaging a tool for turning the retaining nut 28. The retaining nut 28 may have two or more wings 34. In some embodiments, the retaining nut 28 may have two, four, or six wings 34. The plumbing fixture 20 may include an optional center stem 36 for attaching a spray hose to the plumbing fixture 20. The plumbing fixture 20 may also include optional supply hoses 38 in other types of plumbing fixtures 20 or for other uses.

A supply line 40 is attachable to the faucet stem 22 for supplying water to the plumbing fixture 20. The supply line 40 includes a hose 42 and a pipe fitting 44. The pipe fitting 44 may be a female hex nut connector made of stainless steel or other metals. Alternatively, the pipe fitting 44 may be a metal locknut, coupling nut, or toilet supply nut. The pipe fitting 44 includes outer surfaces 46 for engaging a tool for turning the pipe fitting 44. The pipe fitting 44 also includes an inner threaded surface 48 complementary to the outer threaded surface 24 of the faucet stem 22 for connecting the supply line 40 to the faucet stem 22.

As can be seen in FIG. 1, access to the underside of the basin 10 can be limited by the sidewall 16 and the back panel 18. In some embodiments, only a narrow clearance may exist between the sidewall 16 and the back panel 18 for inserting tools to engage and turn the retaining nut 28 or the pipe fitting 44. A basin wrench having a long handle may improve access, but the design can be cumbersome to use and can only apply limited torque. Any open wrench may slip when trying to undo tight connections. Embodiments of this disclosure overcome at least some of these issues.

Figure 5:
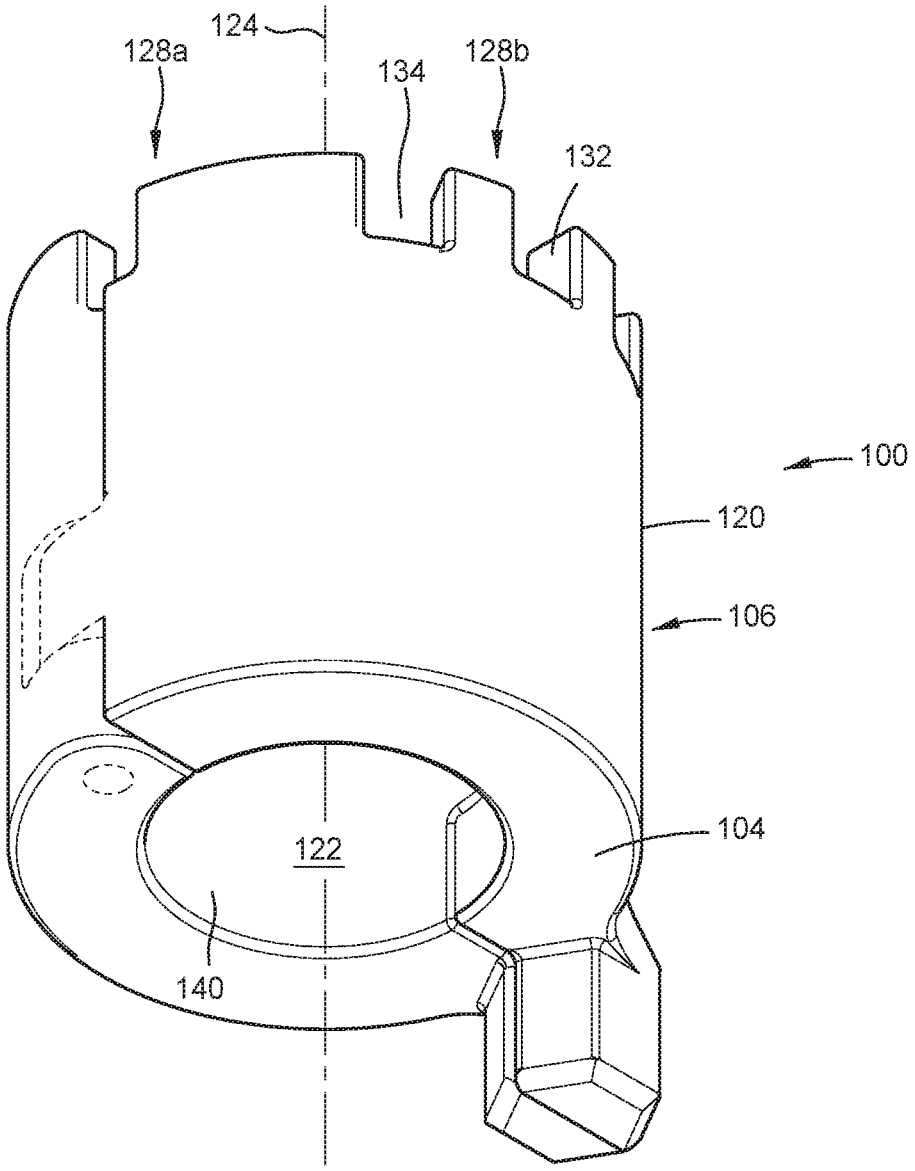
FIG. 5 is bottom-back perspective view of the universal faucet nut wrench in the closed position, in accordance with some embodiments.
Figure 6:
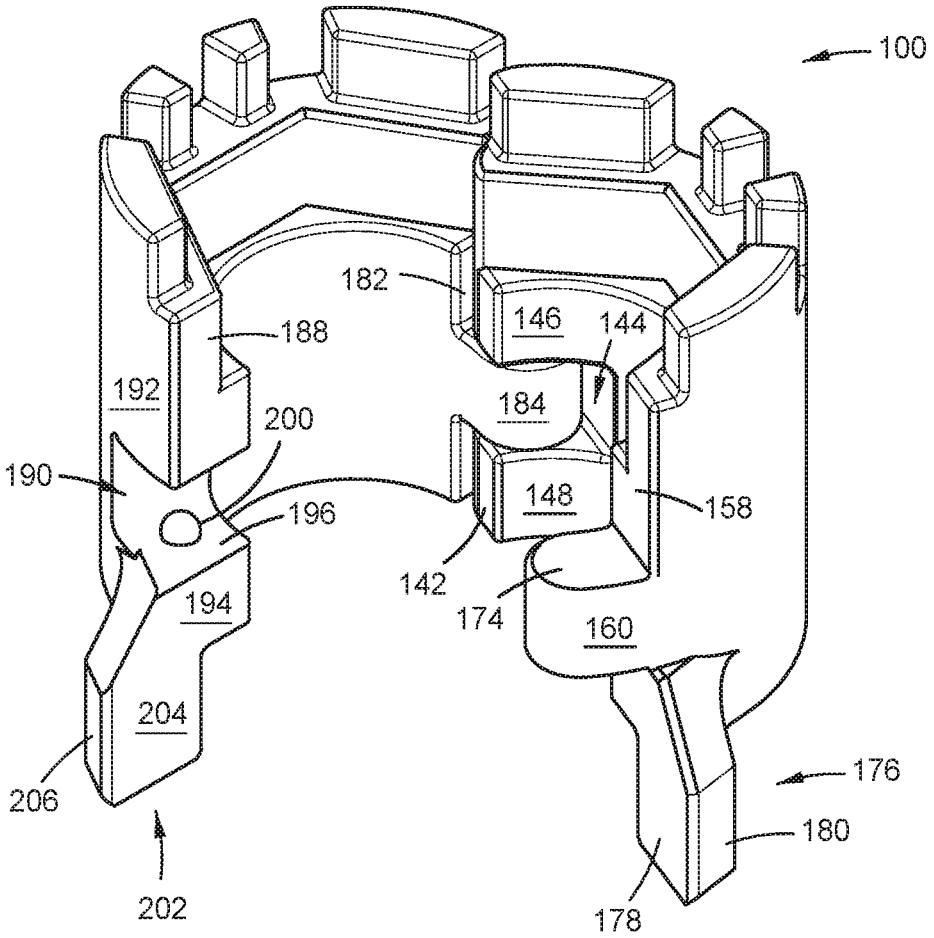
FIG. 6 is a top-front perspective view of the universal faucet nut wrench in an open position, in accordance with some embodiments.
Figure 7:
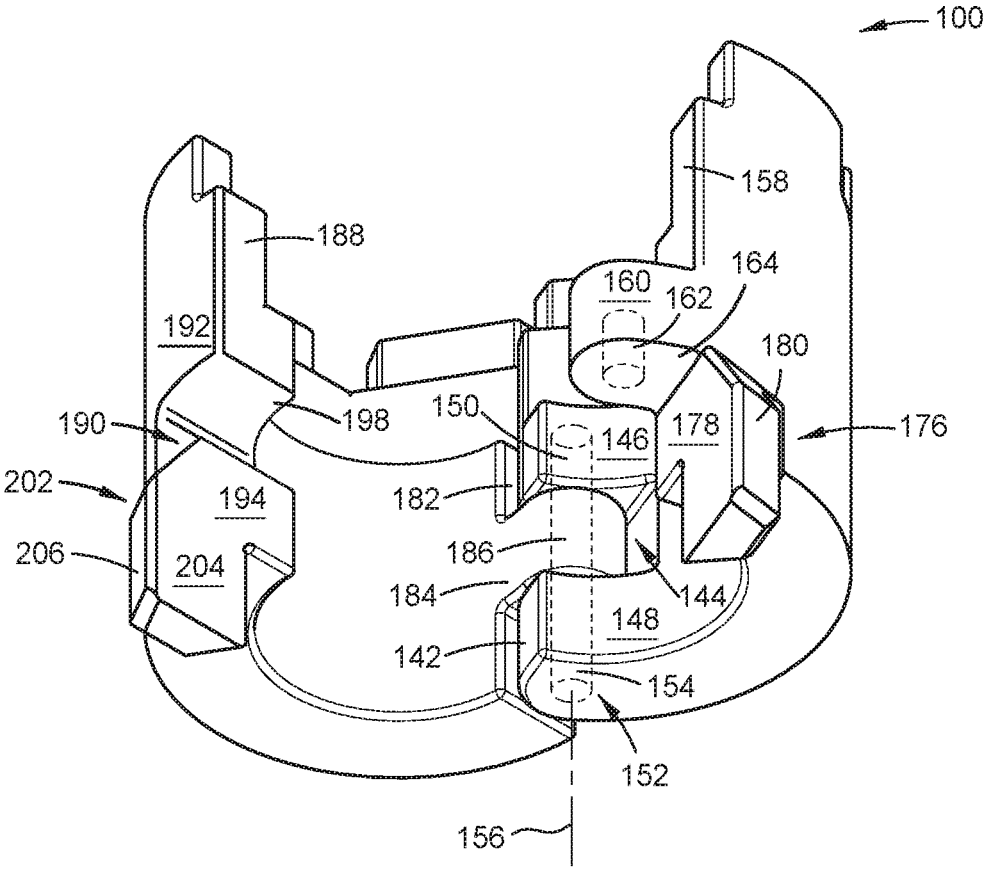
FIG. 7 is a bottom-front perspective view of the universal faucet nut wrench in the open position, in accordance with some embodiments.

The universal faucet nut wrench 100 of this disclosure has a closed position for engaging one of the retaining nut 28 or the pipe fitting 44 (FIGS. 2-5) and an open position for installing around an existing supply line 40 (FIGS. 6-7). The wrench 100 can move between the closed position and the open position.

Figure 2:
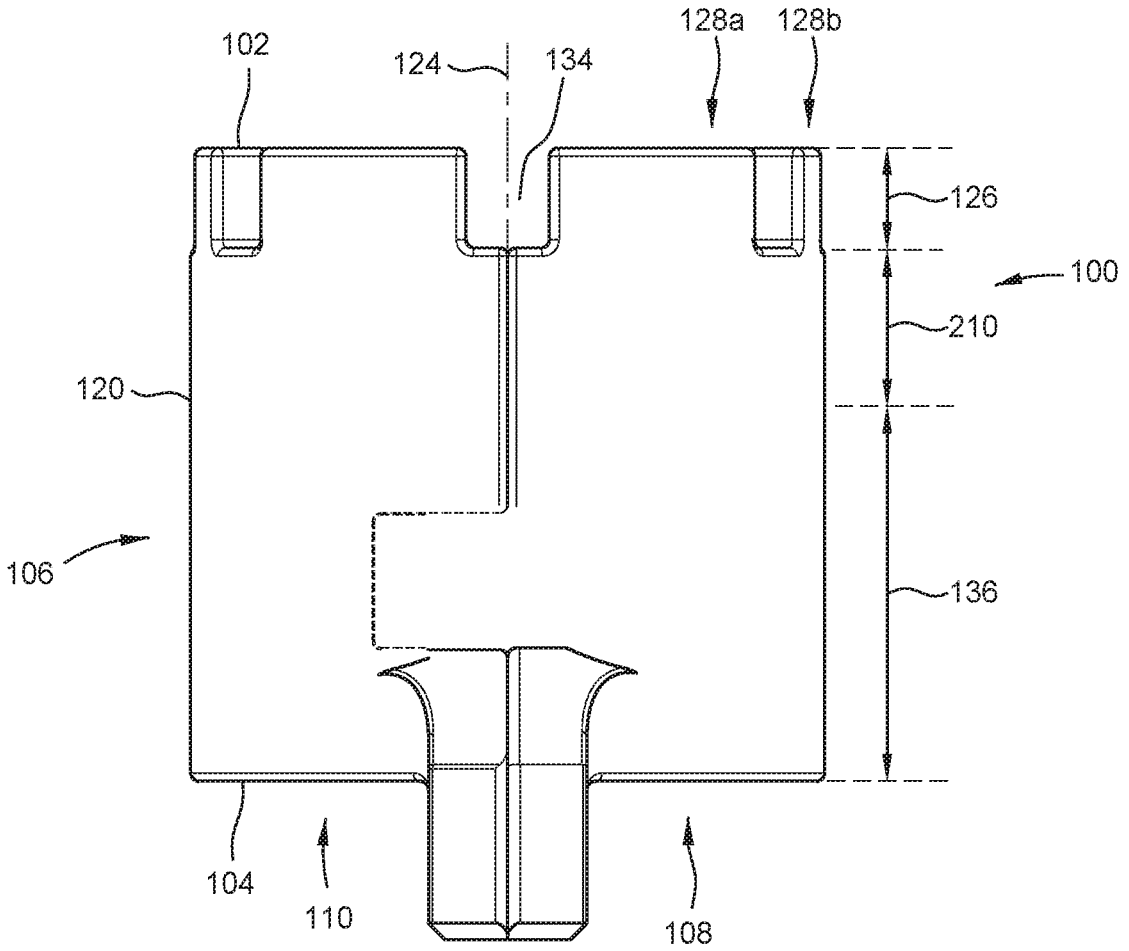
FIG. 2 is a front view of the universal faucet nut wrench in the closed position, in accordance with some embodiments.

FIG. 2 is a front view of the universal faucet nut wrench 100 in the closed position, in accordance with some embodiments. Referring to FIG. 2, the wrench 100 has a first upper face 102, a lower face 104 opposite the first upper face 102, and a body, such as cylindrical body 106, extending between the first upper face 102 and the lower face 104. In some embodiments, the body can be any suitable tool body including without limitation a hex body, a square body, or an oval body. The cylindrical body 106 includes a first section 108 and a second section 110, each section 108, 110 being separately formed. The first and second sections 108, 110 are hingedly connected to each other to allow rotation between the closed position and the open position. The first and second sections 108, 110 together form the cylindrical body 106. The cylindrical body 106 may be, for example, a hex wrench structure in the closed position.

Figure 3:
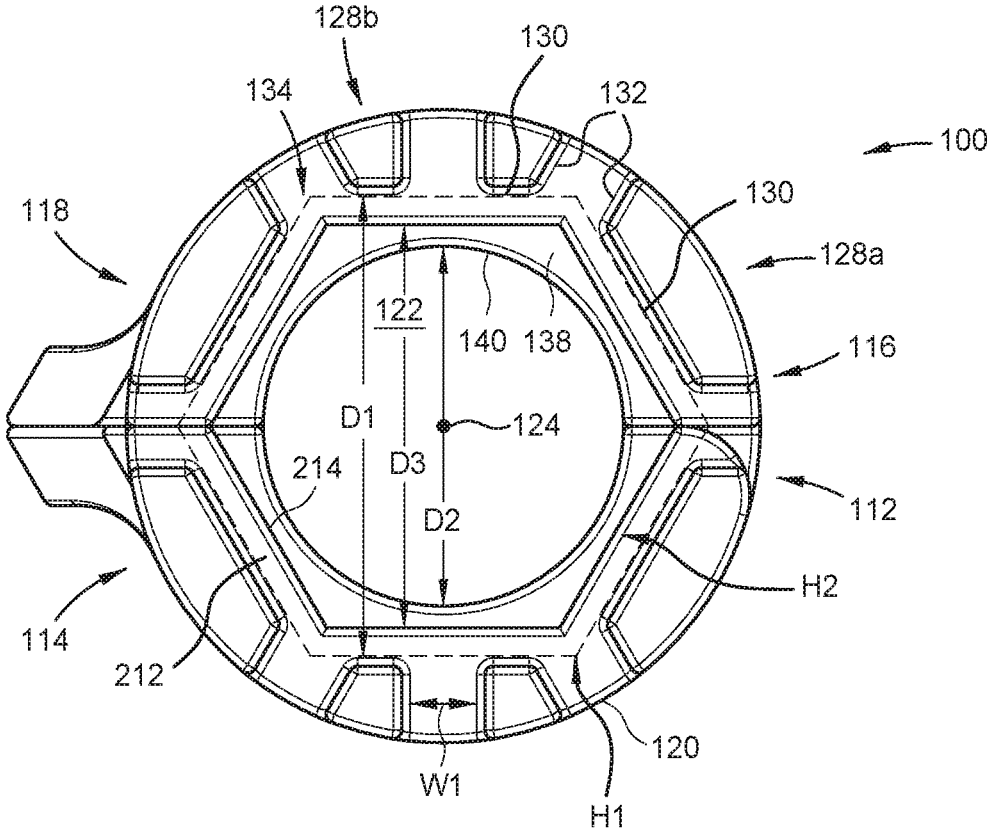
FIG. 3 is a top view of the universal faucet nut wrench in the closed position, in accordance with some embodiments.

FIG. 3 is a top view of the universal faucet nut wrench 100 in the closed position, in accordance with some embodiments. Referring to FIG. 3, the first section 108 includes a first hinge end 112 and a first closure end 114. Likewise, the second section 110 includes a second hinge end 116 complementary in structure to the first hinge end 112 and a second closure end 118 complementary in structure to the first closure end 114.

Referring collectively to FIGS. 2-3, the cylindrical body 106 has an outer surface, such as outer cylindrical surface 120. In some embodiments, the outer surface can have any suitable tool outer surface shape including without limitation a hex surface, a square surface, or an oval surface. The cylindrical body 106 has a longitudinal bore 122 formed therethrough along a first longitudinal axis 124. Each section 108, 110 of the cylindrical body 106 includes a first portion 126, a second portion 136 spaced away from the first portion 126, and a third portion 210 located between the first portion 126 and the second portion 136.

Figure 4:
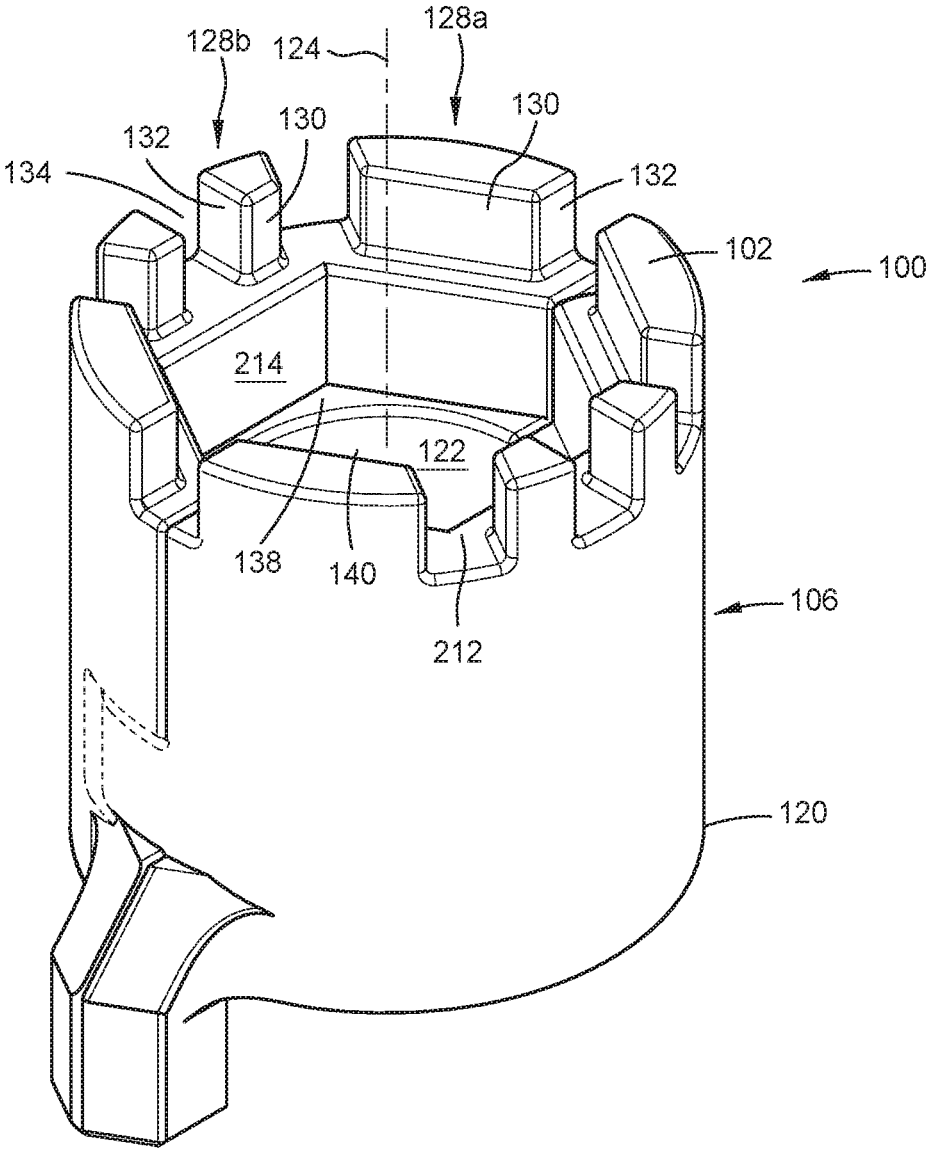
FIG. 4 is a top-front perspective view of the universal faucet nut wrench in a closed position, in accordance with some embodiments.

FIG. 4 is a top-front perspective view of the universal faucet nut wrench 100 in a closed position, in accordance with some embodiments. FIG. 5 is bottom-back perspective view of the universal faucet nut wrench 100 in the closed position, in accordance with some embodiments. Referring collectively to FIGS. 2-5, the first portion 126 includes a plurality of castellations 128 disposed about the first longitudinal axis 124. Each castellation 128 has a first inner surface 130 facing the longitudinal bore 122 and first and second lateral surfaces 132. Each lateral surface 132 of a castellation 128 is parallel to an adjacent surface 132 of an adjacent castellation 128. Each of the first inner surface 130 and the first and second lateral surfaces 132 intersect the first upper face 102. Each first inner surface 130 of the plurality of castellations 128 forms a portion of a hex wrench structure defining a regular hexagon H1 having a first inner minimal diameter D1 (i.e., the distance between parallel sides of H1, see FIG. 3). In some embodiments, the diameter D1 is approximately 1.14 inches. Alternatively, the diameter D1 may be about 1 inch or greater, such as from about 1 inch to about 1¼ inches. Preferably, the diameter D1 corresponds to an industry-standard size of the pipe fitting 44.

The first portion 126 includes a plurality of radial slots 134. Each radial slot 134 has an opening in the first upper face 102. Each radial slot 134 is defined by respective first and second lateral surfaces 132 of adjacent castellations 128. Each radial slot 134 has a first width W1 (FIG. 3). In some embodiments, the first width W1 is approximately 0.20 inches. Alternatively, the first width W1 may be about 3/16 of an inch or greater, such as from about 3/16 of an inch to about ¼ of an inch. Preferably, the first width W1 corresponds to an industry-standard size of the wings 34 of the retaining nut 28. That is, each radial slot 134 may be configured to operatively engage a respective wing 34 of the retaining nut 28 as described in reference to FIG. 1. The first portion 126 may have two or more radial slots 134. In some embodiments, the first portion 126 may have two, four, or six radial slots 134. In order to engage a retaining nut 28 having four or six wings 34, the castellations 128 may include a larger castellation 128*a* and a smaller castellation 128*b*. For example, only one larger castellation 128*a* forms a side of the hex wrench structure, whereas two smaller castellations 128*b* together form a side of the hex wrench structure. In other words, two adjacent smaller castellations 128*b* are equivalent to one larger castellation 128*a* having a radial slot 134 formed therethrough. Although other arrangements are possible, in the illustrated embodiments, the first section 108 includes a larger castellation 128*a* at the hinge end 112, another larger castellation 128*a* at the closure end 114, and two smaller castellations 128*b* between the hinge and closure ends 112, 114. Likewise, the second section 110 includes a larger castellation 128*a* at the hinge end 116, another larger castellation 128*a* at the closure end 118, and two smaller castellations 128*b* between the hinge and closure ends 116, 118.

The cylindrical body 106 includes the hinged second portion 136 having a second upper face 138 opposite the lower face 104. The hinged second portion 136 has a second inner surface, such as second inner cylindrical surface 140 intersecting the second upper face 138 and the lower face 104. In some embodiments, the second inner surface can have any suitable tool inner surface shape including without limitation a hex surface, a square surface, or an oval surface. The second inner cylindrical surface 140 is disposed about the first longitudinal axis 124. The second inner cylindrical surface 140 has a second inner diameter D2 less than the first inner minimal diameter D1 (FIG. 3). In some embodiments, the diameter D2 is approximately 0.85 inches. Alternatively, the diameter D2 may be about ⅞ of an inch or less, such as from about ¾ of an inch to about ⅞ of an inch.

FIG. 6 is a top-front perspective view of the universal faucet nut wrench 100 in an open position, in accordance with some embodiments. FIG. 7 is a bottom-front perspective view of the universal faucet nut wrench 100 in the open position, in accordance with some embodiments. Referring collectively to FIGS. 6-7, with regard to the hinged second portion 136, the first hinge end 112 of the first section 108 has a first hinge face 142. The first hinge end 112 includes a first lateral slot 144 having an opening in the first hinge face 142 and disposed between an upper hinge connector 146 and a lower hinge connector 148. The upper hinge connector 146 includes a first downward facing blind hole 150 for inserting a hinge pin 152. The lower hinge connector 148 includes a first through-hole 154 axially aligned with the first blind hole 150 along a second longitudinal axis 156. The second longitudinal axis 156 is parallel to the first longitudinal axis 124. The hinged second portion 136 also includes the first closure end 114 having a first closure face 158, the first closure end 114 includes a first lateral extension 160 extending from the first closure face 158.

Figure 8:
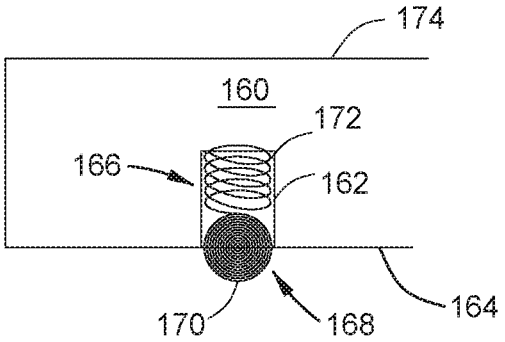
FIG. 8 is a side section view of a portion of the universal faucet nut wrench illustrating a locking mechanism, in accordance with some embodiments.

FIG. 8 is a side section view of a portion of the universal faucet nut wrench 100 illustrating a locking mechanism, in accordance with some embodiments. Referring to FIG. 8, the first lateral extension 160 includes a second downward facing blind hole 162 formed in a downward facing surface 164 thereof. The second blind hole 162 includes a locking device 166 disposed therein. The locking device 166 includes a lock pin 168 extending from the second blind hole 162. The lock pin 168 may be a ball bearing or a bolt made of stainless steel or other metals. The lock pin 168 has a locking surface 170 inclined to horizontal. The lock pin 168 forms a lock via frictional contact between the locking surface 170 and an opposing surface. Alternatively, the lock pin 168 may form a lock in conjunction with a latch structure formed on an opposing surface. In either case, the inclined locking surface 170 can provide sliding contact between the lock pin 168 and an opposing surface. The locking device 166 also includes a coil spring 172 disposed between an end of the second blind hole 162 and the lock pin 168. In this way, the coil spring 172 applies a biasing force to urge the lock pin 168 to extend from the second blind hole 162 at least partially beyond the downward facing surface 164. Alternatively, the lock pin 168 may extend from an upward facing surface 174 of the first lateral extension 160.

The hinged second portion 136 also includes a first adapter portion 176 attached to the outer cylindrical surface 120. The first adapter portion 176 has a first adapter face 178 and a plurality of first outer faces 180.

The second section 110 of the hinged second portion 136 is rotatably coupled to the first section 108. The second hinge end 116 of the second section 110 has a second hinge face 182. The second hinge end 116 includes a second lateral extension 184 extending from the second hinge face 182. The second lateral extension 184 extends into the first lateral slot 144. The second lateral extension 184 includes a second through-hole 186 axially aligned with each of the first blind hole 150 and the first through-hole 154 along the second longitudinal axis 156. The first and second sections 108, 110 are rotatably coupled to each other by the hinge pin 152 disposed through each of the first blind hole 150, the first through-hole 154, and the second through-hole 186.

The second section 110 also includes the second closure end 118 having a second closure face 188. The second closure end 118 includes a second lateral slot 190 having an opening in the second closure face 188 and disposed between an upper closure connector 192 and a lower closure connector 194. The first lateral extension 160 extends into the second lateral slot 190 in the closed position. The locking surface 170 of the lock pin 168 frictionally and slidingly contacts an opposing upward facing surface 196 of the lower closure connector 194 in the closed position, thereby locking together the first and second sections 108, 110. Alternatively, the lock pin 168 may contact an opposing downward facing surface 198 of the upper closure connector 192. Alternatively, either of the upward or downward facing surfaces 196, 198 may include a latch profile 200, and the lock pin 168 may form a lock in conjunction with the latch profile 200. In any case, the locking device 166 prevents relative rotation between the first and second sections 108, 110 and prevents the first lateral extension 160 from being removed from within the second lateral slot 190 without first overcoming the frictional force between the locking device 166 and the upward facing surface 196.

The second section 110 also includes a second adapter portion 202 attached to the outer cylindrical surface 120. The second adapter portion 202 has a second adapter face 204 and a plurality of second outer faces 206.

Figure 9:
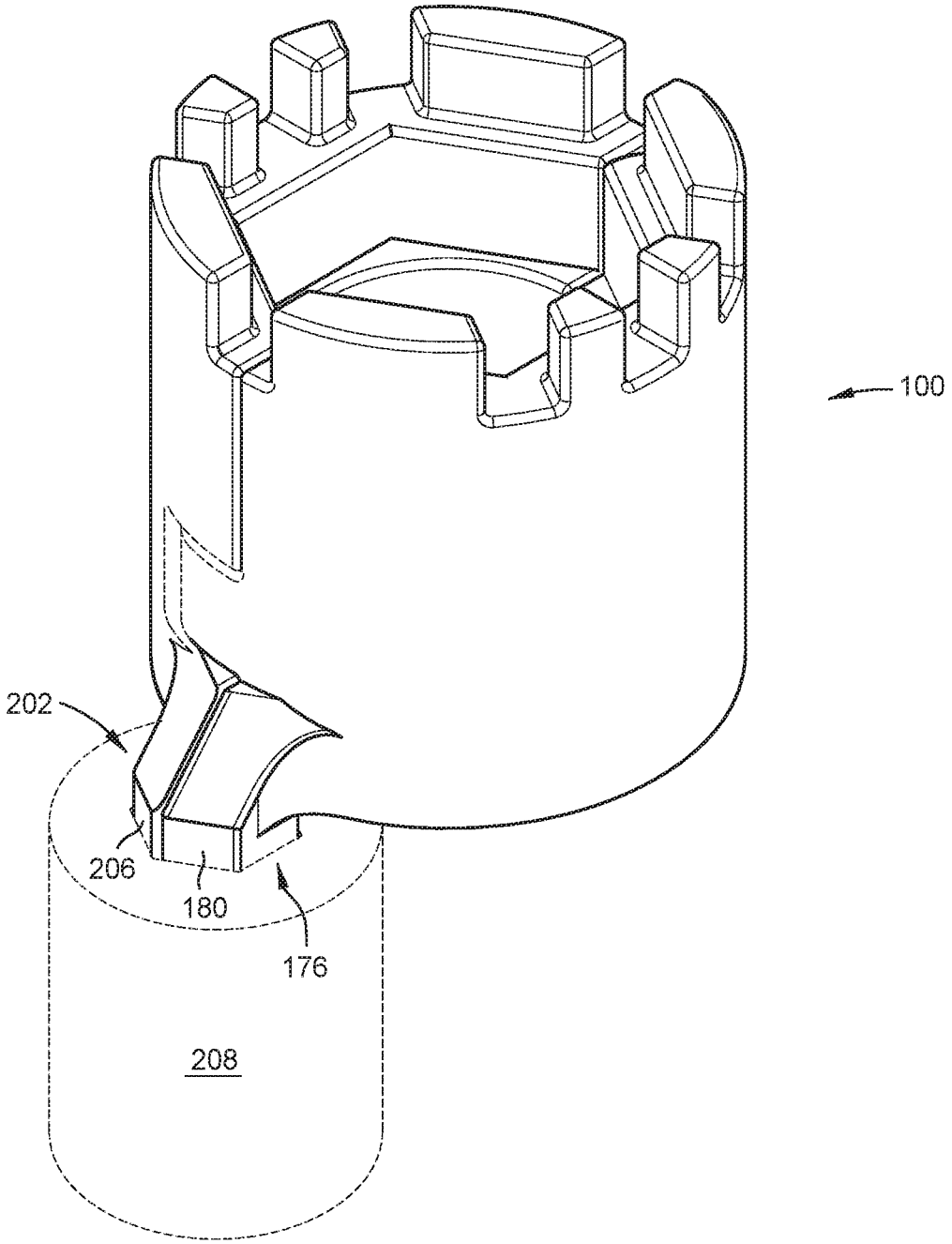
FIG. 9 is a top-front perspective view of the universal faucet nut wrench in the closed position illustrating a drive socket engaging first and second adapter portions of the wrench, in accordance with some embodiments.

FIG. 9 is a top-front perspective view of the universal faucet nut wrench 100 in the closed position illustrating a drive socket 208 engaging first and second adapter portions 176, 202 of the wrench 100. Referring to FIG. 9, the first and second adapter faces 178, 204 contact each other in the closed position. In this way, the first and second adapter portions 176, 202 are collectively engageable to the drive socket 208 in the closed position. Together, the first and second adapter portions 176, 202 are sized to fit, for example, a ⅜ inch drive socket. Alternatively, the first and second adapter portions 176, 202 may be sized to fit drive sockets ranging from ¼ to ½ inch. In addition, the drive socket 208 is adaptable to each of a ratchet and a ratchet extension. The ratchet extension can improve ergonomics, so that the wrench 100 can be operated from an extended distance (i.e., without having to manually reach all the way up under the basin 10). For example, the ratchet extension could be used to access the top wall 14 of the basin 10 even though access may be restricted by the side wall 16. In use, turning a ratchet and/or a ratchet extension attached to the drive socket 208 also turns the wrench 100 about the first longitudinal axis 124.

Referring collectively to FIGS. 2-7, the cylindrical body 106 also includes the third portion 210 located between the first portion 126 and the second portion 136. The third portion 210 has a third upper face 212 opposite the lower face 104. The third portion 210 has a plurality of third inner surfaces 214 intersecting each of the second upper face 138 and the third upper face 212. The plurality of third inner surfaces 214 are disposed about the first longitudinal axis 124 and facing the longitudinal bore 122. The plurality of third inner surfaces 214 collectively form a hex wrench structure defining a regular hexagon H2 having a third inner minimal diameter D3 (i.e., the distance between parallel sides of H2, see FIG. 3) less than the first inner diameter D1 and greater than the second inner diameter D2 (FIG. 3). The diameter D3 is approximately 0.95 inches. Alternatively, the diameter D3 may range from about ⅞ of an inch to about 1 inch. Preferably, the diameter D3 corresponds to an industry-standard size of the pipe fitting 44.

Figure 10:
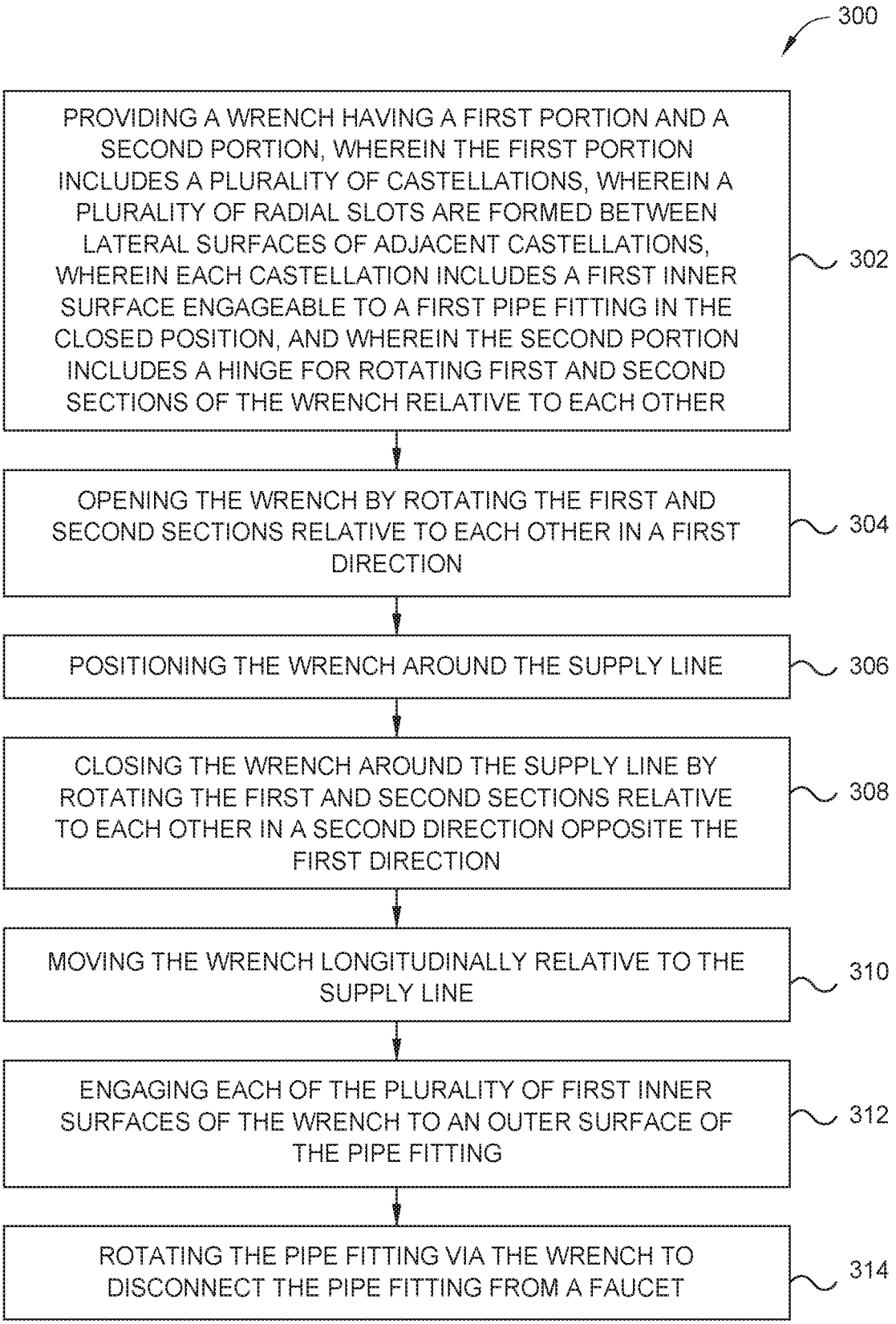
FIG. 10 is a flow chart illustrating a method for disconnecting a pipe fitting of an existing supply line from a faucet, in accordance with some embodiments.

Use of the above described wrench 100 will be explained in the sections that follow. FIG. 10 is a flow chart illustrating a method 300 for disconnecting a pipe fitting 44 of an existing supply line 40 from a faucet 20. Referring to FIG. 10, the method 300 starts by providing the wrench 100 at step 302. At step 304, the method 300 proceeds by opening the wrench 100 by rotating the first and second sections 108, 110 relative to each other in a first direction. Opening the wrench 100 includes removing the first lateral extension 160 from within the second lateral slot 190. With the wrench in the open position (FIGS. 6-7), the method 300 proceeds at step 306 by positioning the wrench 100 around the supply line 40. Step 306 includes moving the wrench to a position where the hose 42 at least partially passes through the longitudinal bore 122 of the wrench 100. At step 308, the method 300 proceeds by closing the wrench 100 around the supply line 40 by rotating the first and second sections 108, 110 relative to each other in a second direction opposite the first direction. Closing the wrench 100 includes extending the first lateral extension 160 into the second lateral slot 190 and thereby engaging the locking device 166. With the wrench 100 in the closed position (FIGS. 2-5), the method 300 proceeds at step 310 by moving the wrench 100 longitudinally relative to the supply line 40. At step 312, the method 300 proceeds by engaging each of the plurality of first inner surfaces 130 of the wrench 100 to an outer surface 46 of the pipe fitting 44. Alternatively, when the pipe fitting 44 is smaller than the third diameter D3, the third inner surfaces 214 of the third portion 210 may instead by used for engaging the outer surfaces 46 of the pipe fitting 44.

At step 314, the method 300 proceeds by rotating the pipe fitting 44 via the wrench 100 to disconnect the pipe fitting 44 from the faucet 20. Disconnecting the pipe fitting 44 includes unthreading the inner thread 48 from the outer thread 24. Step 314 includes engaging the drive socket 208 to the first and second adapter portions 176, 202 and turning the wrench 100 via the drive socket 208 using a ratchet.

Figure 11:
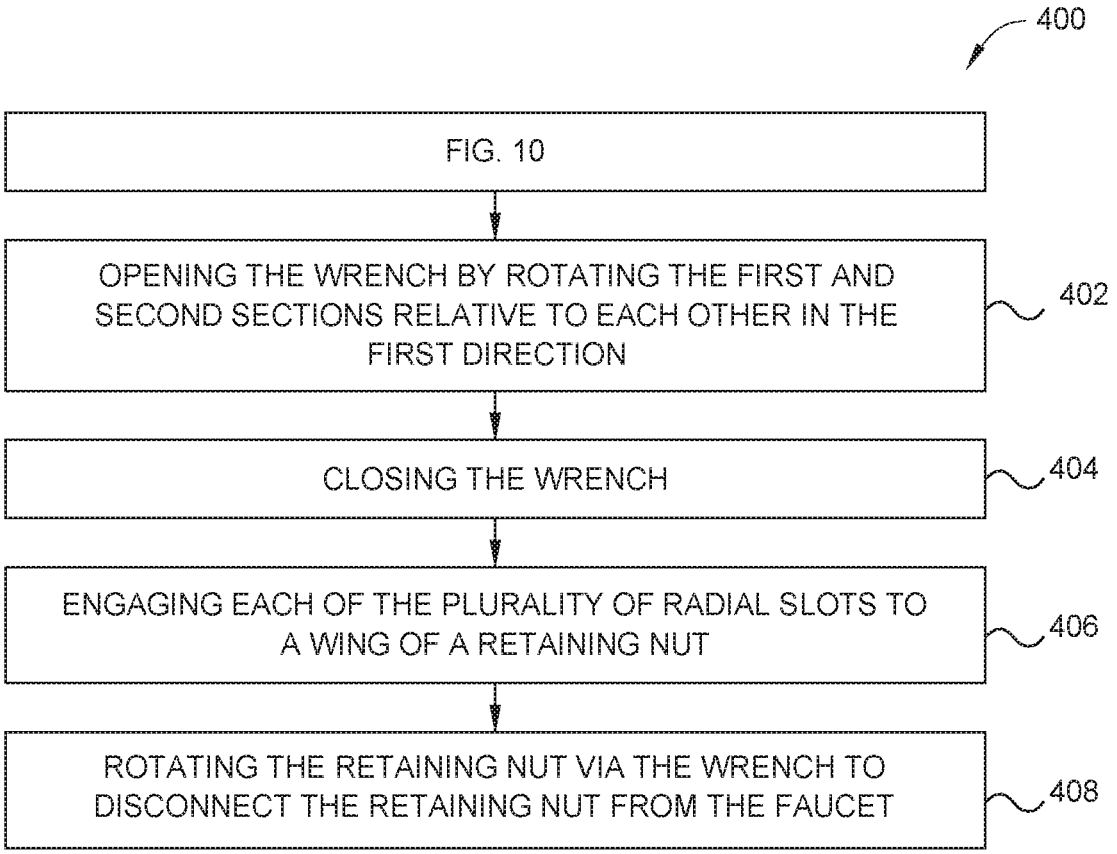
FIG. 11 is a flow chart illustrating a method for disconnecting a retaining nut from a faucet, in accordance with some embodiments.

FIG. 11 is a flow chart illustrating a method 400 for disconnecting a retaining nut 28 from a faucet 20. In some embodiments, the method 400 may be performed immediately following step 314 of the method 300 as illustrated. Alternatively, the method 400 could be performed before the method 300 to more quickly uninstall the faucet 20 from the basin 10. Alternatively, the method 400 may be performed independently of the method 300. The method 400 begins at step 402 by opening the wrench 100 by rotating the first and second sections 108, 110 relative to each other in the first direction. At step 404, the method 400 proceeds by closing the wrench 100. At step 406, the method 400 proceeds by engaging each of the plurality of radial slots 134 to a wing 34 of the retaining nut 28. At step 408, the method 400 proceeds by rotating the retaining nut 28 via the wrench 100 to disconnect the retaining nut 28 from the faucet 20.

Figure 12:
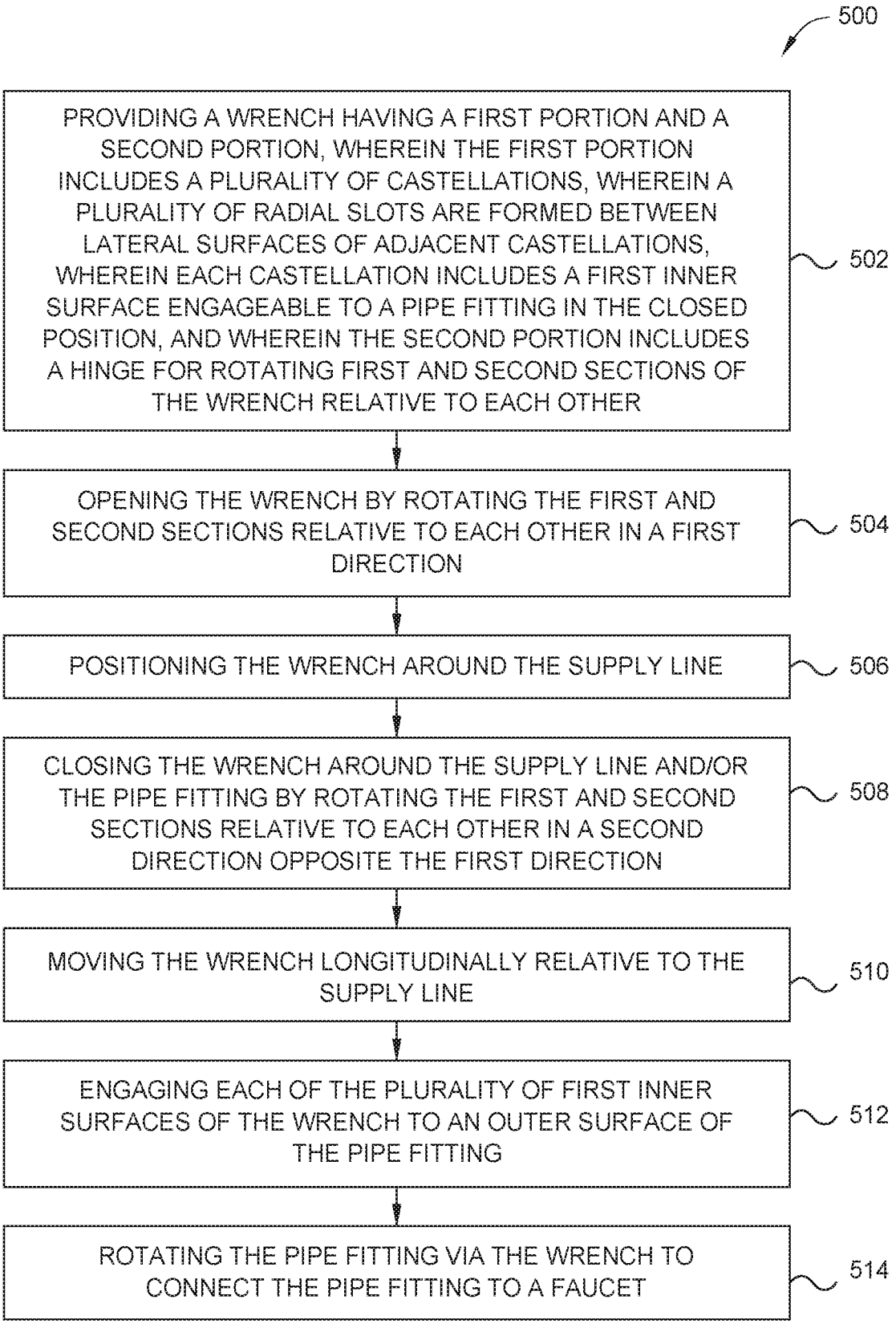
FIG. 12 is a flow chart illustrating a method for connecting a pipe fitting of a supply line to a faucet, in accordance with some embodiments.

FIG. 12 is a flow chart illustrating a method 500 for connecting a pipe fitting 44 of a supply line 40 to a faucet 20. Referring to FIG. 12, the method 500 starts by providing the wrench 100 at step 502. At step 504, the method 500 proceeds by opening the wrench 100 by rotating the first and second sections 108, 110 relative to each other in a first direction. Opening the wrench 100 includes removing the first lateral extension 160 from within the second lateral slot 190. With the wrench in the open position (FIGS. 6-7), the method 500 proceeds at step 506 by positioning the wrench 100 around the supply line 40. Step 506 includes moving the wrench to a position where the hose 42 and/or the pipe fitting 44 at least partially passes through the longitudinal bore 122 of the wrench 100. At step 508, the method 500 proceeds by closing the wrench 100 around the supply line 40 and/or the pipe fitting 44 by rotating the first and second sections 108, 110 relative to each other in a second direction opposite the first direction. In some embodiments, the wrench 100 can be closed directly around the pipe fitting 44. Closing the wrench 100 includes extending the first lateral extension 160 into the second lateral slot 190 and thereby engaging the locking device 166. With the wrench 100 in the closed position (FIGS. 2-5), the method 500 proceeds at optional step 510 by optionally moving the wrench 100 longitudinally relative to the supply line 40. At step 512, the method 500 proceeds by engaging each of the plurality of first inner surfaces 130 of the wrench 100 to an outer surface 46 of the pipe fitting 44. Alternatively, when the pipe fitting 44 is smaller than the third diameter D3, the third inner surfaces 214 of the third portion 210 may instead by used for engaging the outer surfaces 46 of the pipe fitting 44.

At step 514, the method 500 proceeds by rotating the pipe fitting 44 via the wrench 100 to connect the pipe fitting 44 to the faucet 20. Connecting the pipe fitting 44 includes threading the inner thread 48 to the outer thread 24. Step 314 includes engaging the drive socket 208 to the first and second adapter portions 176, 202 and turning the wrench 100 via the drive socket 208 using a ratchet. In some embodiments, a ratchet extension can be used for improved ergonomics, such as for plumbing work that has a tight clearance or is otherwise difficult to reach manually.

Figure 13:
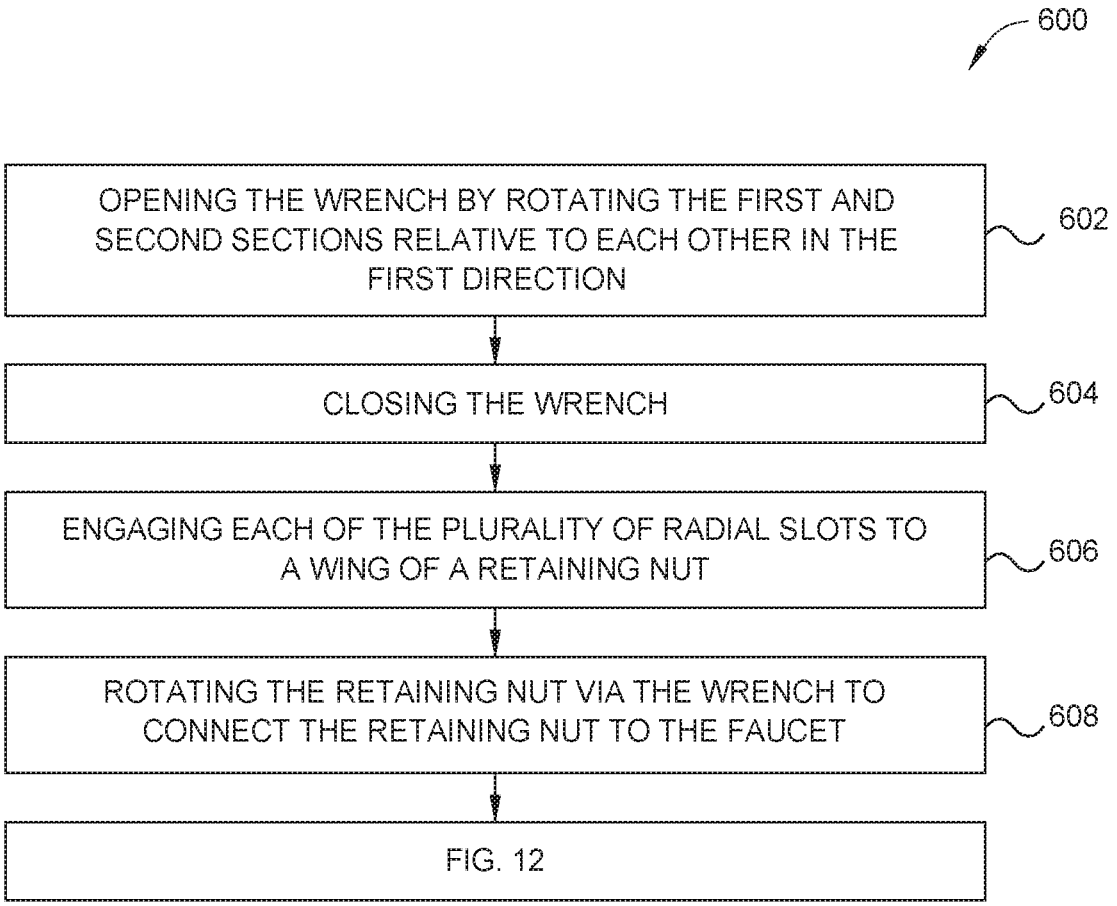
FIG. 13 is a flow chart illustrating a method for connecting a retaining nut to a faucet, in accordance with some embodiments.

FIG. 13 is a flow chart illustrating a method 600 for connecting a retaining nut 28 to a faucet 20. In some embodiments, the method 600 may be performed before performing the method 500 as illustrated. Alternatively, the method 600 may be performed independently of the method 500. The method 600 begins at step 602 by opening the wrench 100 by rotating the first and second sections 108, 110 relative to each other in the first direction. At step 604, the method 600 proceeds by closing the wrench 100. At step 606, the method 600 proceeds by engaging each of the plurality of radial slots 134 to a wing 34 of the retaining nut 28. At step 608, the method 600 proceeds by rotating the retaining nut 28 via the wrench 100 to connect the retaining nut 28 to the faucet 20.

While the foregoing is directed to embodiments of the present disclosure, other and further embodiments of the disclosure may be devised without departing from the basic scope thereof, and the scope thereof is determined by the claims that follow.

What is claimed is:

1. A universal faucet nut wrench having an open position for installing around an existing supply line and a closed position for engaging one of a retaining nut or a pipe fitting, comprising:

a body having first and second sections rotatably coupled to each other, the body including:

a first portion having a plurality of castellations, wherein a plurality of radial slots are formed between lateral surfaces of adjacent castellations, wherein each radial slot is engageable to a wing of a retaining nut, and wherein the first portion includes a plurality of first inner surfaces engageable to a first pipe fitting in the closed position;

a second portion spaced away from the first portion, wherein the second portion includes a hinge for rotating the first and second sections relative to each other; and a third portion located between the first and second portions, wherein the third portion includes a plurality of second inner surfaces engageable to a second pipe fitting in the closed position.

2. The wrench of claim 1, wherein the first section includes:

a first hinge end having a first lateral slot; and a first closure end having a first lateral extension extending therefrom; and wherein the second section includes:

a second hinge end complementary to the first hinge end and including a second lateral extension extending therefrom, the second lateral extension extending into the first lateral slot; and a second closure end complementary to the first closure end and including a second lateral slot, wherein the first lateral extension extends into the second lateral slot in the closed position.

3. The wrench of claim 2, wherein the first lateral slot is disposed between an upper hinge connector having a downward facing blind hole and a lower hinge connector having a first through-hole axially aligned with the blind hole.

4. The wrench of claim 3, wherein the second lateral extension comprises a second through-hole axially aligned with each of the blind hole and the first through-hole, wherein the first and second sections are rotatably coupled by a hinge pin disposed through the blind hole and the first and second through-holes.

5. The wrench of claim 2, wherein the first lateral extension comprises a locking device including a lock pin and a spring.

6. The wrench of claim 5, wherein the spring contacts the lock pin forcing the lock pin to extend at least partially beyond a downward facing surface of the first lateral extension, and wherein the lock pin has a locking surface for frictionally contacting an opposing surface of the second lateral slot.

7. The wrench of claim 1, wherein the first section further comprises a first adapter portion attached to the body, the first adapter portion including:

a first adapter face; and a plurality of first outer faces.

8. The wrench of claim 7, wherein the second section further comprises a second adapter portion attached to the body, the second adapter portion including:

a second adapter face contacting the first adapter face in the closed position; and a plurality of second outer faces, wherein the first and second outer faces are collectively adaptable to a drive socket in the closed position.

9. The wrench of claim 1, wherein the first portion has a first inner diameter, wherein the second portion has a second inner diameter less than the first inner diameter, and wherein the third portion has a third inner diameter less than the first inner diameter and greater than the second inner diameter.

10. The wrench of claim 9, wherein the first inner diameter is approximately 1 inch or greater, wherein the second inner diameter is approximately ⅞ of an inch or less, and wherein the third inner diameter is from about ⅞ of an inch to about 1 inch.

11. A method for disconnecting a pipe fitting from a faucet and/or connecting the pipe fitting to the faucet, comprising:

providing a wrench having a first portion and a second portion, wherein the first portion includes a plurality of castellations, wherein a plurality of radial slots are formed between lateral surfaces of adjacent castellations, wherein each castellation includes a first inner surface engageable to a first pipe fitting in the closed position, and wherein the second portion includes a hinge for rotating first and second sections of the wrench relative to each other;

opening the wrench by rotating the first and second sections relative to each other in a first direction;

installing the wrench around the supply line;

closing the wrench around the supply line by rotating the first and second sections relative to each other in a second direction opposite the first direction;

moving the wrench longitudinally relative to the supply line;

engaging each of the plurality of first inner surfaces of the wrench to an outer surface of the pipe fitting; and rotating the pipe fitting via the wrench, wherein rotating the pipe fitting performs at least one of:

disconnecting the pipe fitting from the faucet; and connecting the pipe fitting to the faucet.

12. The method of claim 11, wherein the first section includes a first closure end having a closure extension, wherein the second section includes a closure slot, and wherein opening the wrench further comprises removing the closure extension from within the closure slot.

13. The method of claim 11, wherein closing the wrench further comprises extending the closure extension into the closure slot.

14. The method of claim 11, wherein the wrench includes first and second adapter portions being collectively adaptable to a drive socket in the closed position, and wherein rotating the pipe fitting via the wrench comprises:

engaging the drive socket to the first and second adapter portions; and turning the drive socket using a ratchet.

15. The method of claim 11, further comprising, after rotating the pipe fitting via the wrench to disconnect the pipe fitting:

opening the wrench by rotating the first and second sections relative to each other in the first direction;

closing the wrench;

engaging each of the plurality of radial slots to a wing of a retaining nut; and rotating the retaining nut via the wrench to disconnect the retaining nut.

16. The method of claim 15, wherein the wrench includes first and second adapter portions being collectively adaptable to a drive socket in the closed position, and wherein rotating the retaining nut via the wrench comprises:

engaging the drive socket to the first and second adapter portions; and turning the drive socket using a ratchet.

17. A universal faucet nut wrench having an open position for installing around an existing supply line and a closed position for engaging one of a retaining nut or a pipe fitting, comprising:

a body having first and second sections rotatably coupled to each other, the body including:

a first portion having a plurality of castellations, wherein a plurality of radial slots are formed between lateral surfaces of adjacent castellations, and wherein each radial slot is engageable to a wing of a retaining nut; and a second portion located adjacent the first portion, wherein the second portion includes a plurality of second inner surfaces engageable to a first pipe fitting in the closed position.

18. The wrench of claim 17, further comprising a third portion adjacent the second portion, wherein the third portion includes a hinge for rotating the first and second sections relative to each other.

19. The wrench of claim 18, wherein the third portion further includes a locking device for locking the wrench in the closed position.

20. The wrench of claim 17, wherein the first portion further includes a plurality of first inner surfaces engageable to a second pipe fitting in the closed position.

* * * * *